US005413081A

United States Patent [19]

Collingborn

[11] Patent Number: 5,413,081

[45] Date of Patent: May 9, 1995

[54] FUEL PUMPS

[75] Inventor: Peter A. G. Collingborn, Kent, United Kingdom

[73] Assignee: Lucas Industries Public Limited Company, Solihull, United Kingdom

[21] Appl. No.: 297,095

[22] Filed: Aug. 29, 1994

[30] Foreign Application Priority Data

Sep. 18, 1993 [GB] United Kingdom ..... 9319363

[51] Int. Cl.[6] ..... F02M 37/04

[52] U.S. Cl. ..... 123/506; 123/450

[58] Field of Search ..... 123/450, 506, 447, 179.17; 417/462

[56] References Cited

U.S. PATENT DOCUMENTS

| | | | |
|---|---|---|---|
| 4,764,092 | 8/1988 | Thornthwaite | 417/462 |
| 4,920,940 | 5/1990 | Harris | 123/447 |
| 5,027,776 | 7/1991 | Nicol | 123/447 |
| 5,044,345 | 9/1991 | Collingborn | 123/450 |
| 5,044,893 | 9/1991 | Collingborn | 123/506 |
| 5,044,899 | 9/1991 | Nicol | 123/506 |
| 5,103,972 | 4/1992 | Winkler | 123/506 |
| 5,203,303 | 4/1993 | Collingborn | 123/506 |
| 5,207,202 | 5/1993 | Collingborn | 123/447 |

*Primary Examiner*—Carl S. Miller

*Attorney, Agent, or Firm*—Jacobson, Price, Holman & Stern

[57] ABSTRACT

A fuel pumping apparatus of the rotary distributor type includes a fluid pressure actuable spill valve member operable to terminate delivery of fuel through an outlet from a bore containing the pumping plungers. The valve member is moved to the open position by an actuating piston. One end of the cylinder containing the actuating piston is connected to a low pressure source of fuel by way of a non-return valve and the same end of the cylinder can be connected by a control valve to a high pressure source of fuel when spillage of fuel is required. Associated with the piston is a balance piston and the two pistons define a flow path for fuel from the one end of the cylinder to the bore to ensure that the bore is completely full of fuel prior to the next delivery of fuel through an outlet.

10 Claims, 2 Drawing Sheets

FUEL PUMPS

This invention relates to a fuel pumping apparatus for supplying fuel to a compression ignition engine and of the kind comprising a pumping plunger slidable within a bore, a cam for imparting inward movement to the plunger in timed relationship with the associated engine, means for distributing fuel displaced from the bore during successive inward movements of the plunger to a plurality of outlets in turn, said outlets in use being connected to the injection nozzles respectively of the associated engine, a spill valve operable to spill fuel from the bore during inward movement of the plunger, an actuating piston slidable within a cylinder, the actuating piston being biased by first resilient means towards an end wall of the cylinder, said spill valve comprising a valve member which is carried by the actuating piston and a seating which is formed in said end wall of the cylinder about a passage communicating with said bore, valve means for admitting fluid under pressure into the cylinder to effect an initial movement of the actuating piston away from said end wall thereby lifting the valve member from the seating to allow fuel to spill from the bore into the cylinder and effect further movement of the actuating piston, a drilling formed in the actuating piston, the diameter of said drilling being slightly greater than the effective seat diameter of the valve member and seating, a balance piston slidable in said drilling, second resilient means biasing the balance piston in the direction towards said one end wall of the cylinder, a stop to limit the movement of the balance piston in the direction away from said end wall of the cylinder, a passage in the valve member and actuating piston whereby the balance piston is subjected to the fuel pressure in the bore and means for supplying fuel to the bore to replenish the fuel lost through leakage and the fuel displaced to the associated engine.

An apparatus of the kind specified is described in EP-A-0453145 and as described the purpose of the balance piston is to absorb the initial quantity of fuel displaced by the plunger. Moreover, the means for supplying fuel to the bore comprises a low pressure fuel supply pump the outlet of which is connected to the bore through a series of passages formed in a rotary distributor member which cooperate in turn with an inlet port in a housing. The distributor member also houses the bore and the plunger and provides by means of a delivery passage communicating with the bore, the distributing function. The cam is formed on a cam ring which is angularly adjustable about the axis of rotation of the distributor member to allow for timing adjustment. The sizes of the various ports and passages have to be carefully chosen to allow sufficient time to complete the filling of the bore whilst taking into account that the communication periods of the various ports and passages must be sufficient to allow for timing variation. There is a general tendency for compression ignition engines to operate at increased speeds and increasing the speed means that there is less real time available to fill the bore with fuel. This is particularly the case with apparatus intended to supply fuel to six or more engine cylinders.

It is known in the fuel pumping apparatus art to supply fuel to the bore containing the pumping plunger or plungers through a so called inlet check valve a known form of which comprises a ball which is spring-biased into engagement with a seating. Such valves however have to withstand the high pressure of fuel which is developed in the bore during the delivery of fuel to the engine. Moreover, the operation of such valves can be erratic and it is known to incorporate into the design of the valve a pressure responsive plunger which provides assistance in moving the valve members of the valve to the closed position.

The object of the present invention is to provide an apparatus of the kind specified in an improved form.

According to the invention in an apparatus of the kind specified the actuating piston and balance piston define valve means for connecting said bore to a source of fuel under pressure, said balance piston when the bore is full of fuel moving against the action of its spring loading relative to the actuator piston to interrupt communication between the bore and said source of fuel, the balance piston being moved into engagement with its stop during the initial inward movement of the plunger.

An example of an apparatus in accordance with the invention will now be described with reference to the accompanying drawings in which.

Figure 1:
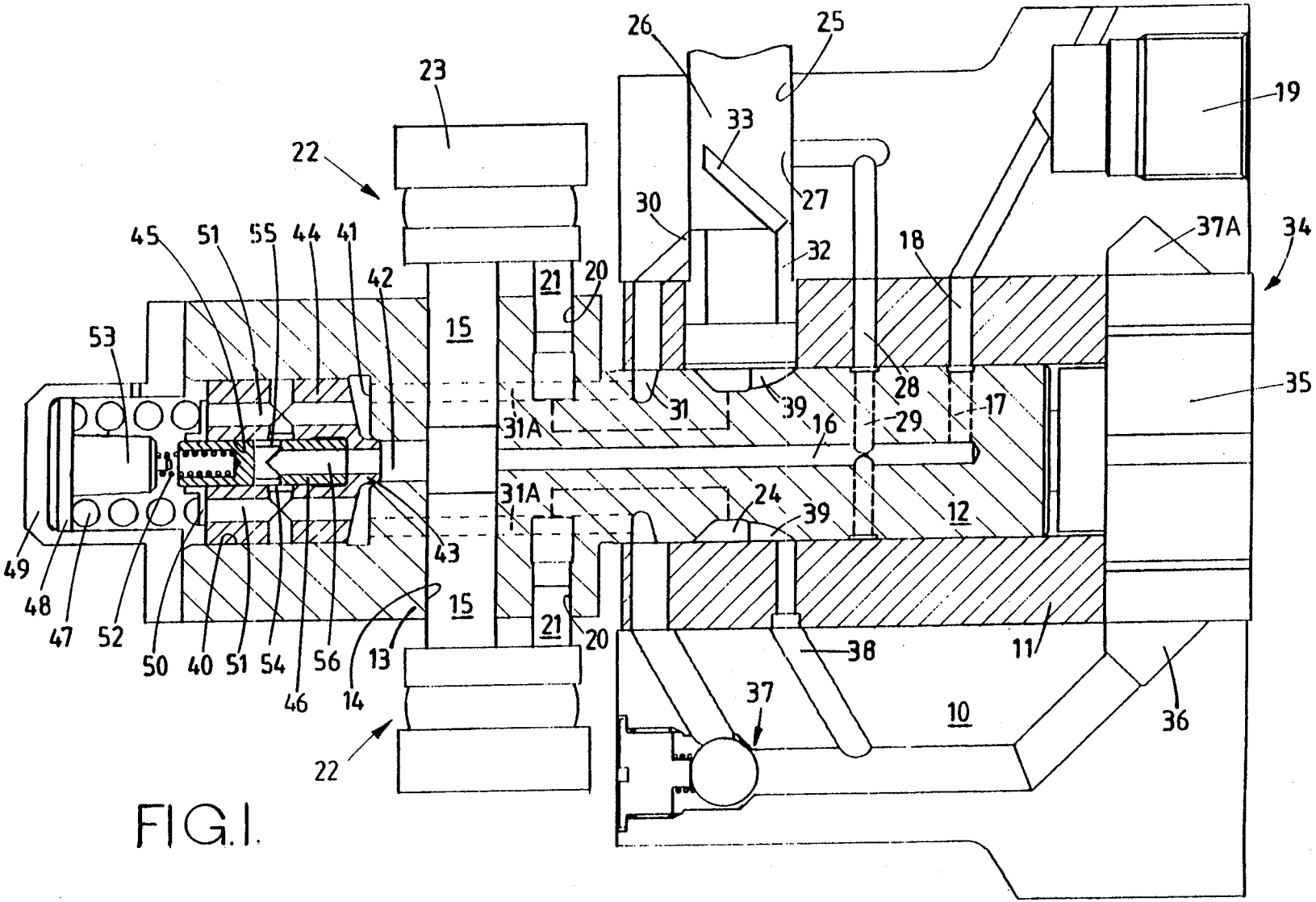
FIG. 1 is a sectional side elevation of a portion of the apparatus.

Referring to the drawings the apparatus comprises a housing 10 in which is mounted a fixed sleeve 11. Rotatably mounted in the sleeve is a rotary distributor member 12 having an extension 13 which extends from the sleeve and which is coupled to a drive shaft not shown. The drive shaft is driven in timed relationship with the associated engine.

Formed in the extension 13 is a transversely extending bore 14 in which is mounted a pair of pumping plungers 15. The space intermediate the plungers constitutes the pumping chamber of the high pressure pump and this communicates with a longitudinal passage 16 formed in the distributor member. The passage 16 communicates with an outwardly extending delivery passage 17 and this is positioned to register in turn with a plurality of outlet ports 18 which are formed in the sleeve and which communicate with outlets 19 respectively formed in the housing. The outlets 19 are connected in use, to the injection nozzles respectively of the associated engine.

Also formed in the extension 13 of the distributor member is a pair of blind auxiliary bores 20 in each of which is mounted an auxiliary plunger 21. The bores 20 extend parallel to the bore 14 and at their outer ends, each plunger 15 and its adjacent auxiliary plunger 21 engage a cam follower 22, each cam follower including a roller which is in engagement with the internal peripheral surface of an annular cam ring 23 which is secured within the housing of the apparatus but which is allowed limited angular movement about the axis of rotation of the distributor member.

The inner ends of the bores 20 communicate with a circumferential groove 24 formed in the periphery of the distributor member and this groove is in constant communication with the inner end of a shuttle bore 25 which contains an axially movable and angularly adjustable shuttle 26. The shuttle is biased in the direction towards the distributor member by a spring not shown or by a hydraulic bias arrangement. Opening into the shuttle bore is a first port 27 which communicates with a transfer port 28 which opens onto the periphery of the distributor member at a position to register in turn with a plurality of passages 29 which communicate with the passage 16.

A second port 30 opens into the shuttle bore at a position nearer to the distributor member and this port is in constant communication with a circumferential groove 31 formed in the periphery of the distributor member. The shuttle 26 is provided with a circumferential groove 32 which is in constant communication with the port 30 and extending from the groove 32 is an inclined groove 33.

Also provided is a low pressure pump generally indicated at 34 and this includes a rotor 35 which is coupled to the distributor member. The low pressure pump has an outlet 36 and an inlet 37A which is connected to a source of fuel. The inlet and outlet are coupled by a relief valve not shown so that the pressure of fuel delivered by the low pressure pump will vary in accordance with the speed at which the apparatus is driven.

The outlet 36 is connected to the circumferential groove 31 by way of a non-return valve 37 and in addition, the outlet 36 is connected to a supply port 38 which opens onto the periphery of the distributor member so as to be capable of registering in turn with a plurality of supply grooves 39 which extend from the circumferential groove 24.

Formed in the extension 13 of the distributor member is a cylinder 40 having an end wall 41 into which opens a spill passage 42 which communicates with the bore 14 intermediate the plungers 15. Also opening onto the end wall are a pair of passages 31A which communicate with the groove 31. Surrounding the passage 42 is a valve seat for engagement by a valve member 43 which is integrally formed with an actuating piston 44 slidable in the cylinder. The actuating piston is provided with a drilling 45 which extends axially within the piston from the end thereof remote from the valve member. The drilling has a reduced portion which extends through the valve member 43 and the diameter of the wider portion of the drilling is slightly larger than the seat diameter of the valve member 43 and the seating. Slidable within the wider portion of the drilling is a balance piston 46.

The actuating piston 44 is biased by a first coiled compression spring 47 which is interposed between a spring abutment 48 engaged with the end wall of a hollow cap 49 secured to the extension 13 and a further spring abutment 50 which engages the piston. The spring abutment 50 serves also as a valve plate to close the adjacent ends of a pair of axial passages 51 extending between the ends of the actuating piston. A second coiled compression spring 52 is provided to bias the balancing piston 46 in the direction towards the end wall 41 and this spring is partly located in a recess in the piston and engages a spigot 53 extending from the abutment 48.

The axial passages 51 in the actuating piston communicate with a circumferential groove 54 formed in the drilling 45, by way of cross passages. Moreover, for communication with the groove 54 there is formed in the peripheral surface of the balance piston a further circumferential groove 55 which communicates by way of a passage 56 with the narrower portion of the drilling 45.

In operation, the parts of the apparatus are shown in FIG. 1 in the position which they adopt towards the end of the filling period of the bores 14 and 20. Fuel is being supplied to the bore 14 through the non-return valve 37 and this fuel flows by way of the passages 31A to the cylinder 40 and then along the passages 51 to the grooves 54 and 55 and then through the passages 56 and 42 to the bore. The bores 20 receive fuel by way of the supply port 38 and one of the supply grooves 39.

When the rollers of the cam followers 22 engage the base circle of the cam lobes on the cam ring outward movement of the pumping plungers ceases and the fuel pressure in the bore 14 increases and the balance piston 46 moves against the action of its spring 52 so that communication between the grooves 54 and 55 is just broken. The bores 14 and 20 at the end of the filling period are therefore completely full of fuel and furthermore, the shuttle is in its innermost position and the valve 37 is closed.

As the distributor member rotates the supply groove 39 moves out of register with the supply port 38 and the delivery passage 17 moves into register with one of the outlet ports 18. In addition, one of the passages 29 moves into register with the transfer port 28. As the plungers 15 start to move inwardly the initial displacement of fuel from the bore 14 will displace the balance plunger 46 into engagement with the spigot 53. This movement ensures that the grooves 54 and 55 are separated by an adequate sealing land and once the movement of the balance piston is halted fuel under pressure is supplied to the associated engine.

The auxiliary plungers 21 start to move inwardly at the same time as the plungers 15 and fuel is displaced from the bores 20 to the shuttle bore 25 thereby causing movement of the shuttle in the axial direction.

Delivery of fuel and outward movement of the shuttle take place as the distributor further rotates until the port 27 registers with the groove 33. When this takes place fuel at the high pressure within the bore 14 is conducted to the cylinder 40 by way of the groove 32, the port 30 and the passages 31A. The high pressure acts on the actuator piston which lifts the valve member 43 from the seating and the fuel displaced by the plungers 15 flows by way of the passage 42 into the cylinder. The fuel pressure in the bore 14 falls quickly and this allows the fuel pressure actuated valve member in the fuel injection nozzle to close quickly. The angular setting of the shuttle 26 determines the instant at which the valve member 43 is lifted from the seating and therefore the amount of fuel supplied to the associated engine.

As the distributor member further rotates any further inward movement of the plungers results in further movement of the actuating piston and the shuttle. When the rollers ride over the crests of the cam lobes the plungers can move outwardly and the passage 17 moves out of register with the outlet port 18 and the passage 29 moves out of register with the transfer port 28. As soon as the plungers can move outwardly the actuating piston 44 and the shuttle 26 move under the action of their resilient loading and displace fuel back into the bore 14 and the bores 20 respectively. In the case of the actuating piston the strength of the spring 47 is such that the fuel pressure in the cylinder 40 is higher than the output pressure of the low pressure pump 34. The valve 37 therefore remains closed and the plungers are forced outwardly by the fuel pressure. Only when the valve member 43 engages with the seating and the pressure in the bore 14 has fallen sufficiently to allow movement of the balance piston to bring the grooves 54, 55 into communication does the valve 37 open to allow fuel to flow from the low pressure pump into the bore 14 to allow the plungers to move outwardly their maximum extent. The provision of the valve 37 as opposed to the porting arrangement shown in EP-A-0453145 means that the higher fuel pressure which is developed in the cylinder 40 by the action of the spring 47 is utilised to drive the plungers 15 outwardly so that the rollers of the cam followers follow the initial portions of the trailing flanks of the cam lobes and this can result in a substantial shortening of the time required to fill the bore 14. Moreover, the valve 37 is protected from the high pressure which is developed in the bore 14 by the valve means constituted by the actuating and balance pistons.

Figure 2:
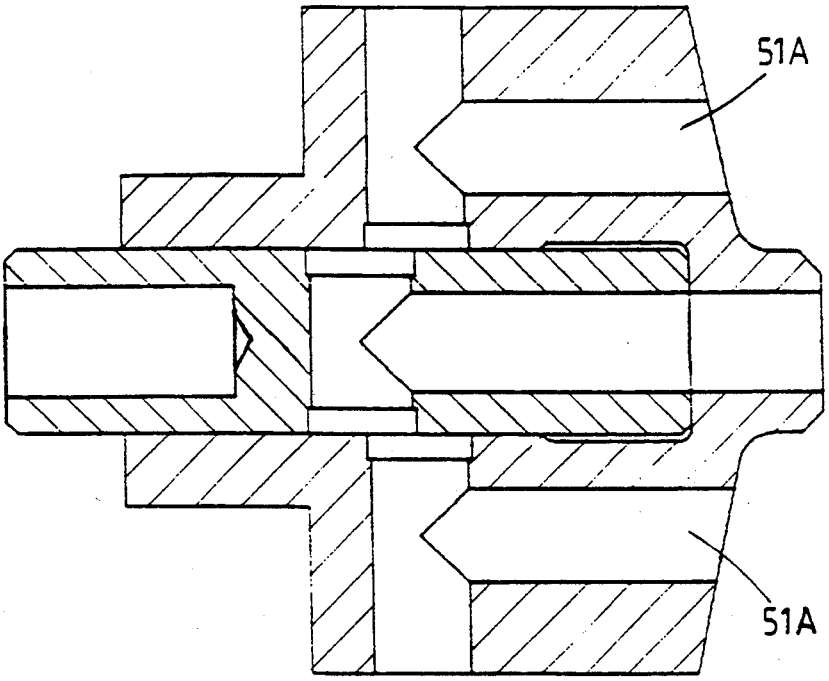
FIG. 2 is a view showing an alternative form of part of the apparatus seen in FIG. 1.

The passages 51 extend the length of the actuating piston and have their ends closed by the abutment 50 in order to protect against excessive pressure rise if the piston should seize in the cylinder. FIG. 2 shows a modification in which the passages 51A extend only so far as the cross drilling so that the aforesaid protection is not obtained. However, the inertia of the piston is reduced as is the length of the spring housing or rotor.

It will be understood that the drilling 45 is slightly larger in diameter than the seat area in order to ensure that the valve member 43 is held in engagement with the seating by fuel pressure during the inward movement of the plungers.

In the apparatus described in EP-A-0453145 it is necessary to provide a leakage path from the cylinder to ensure that the valve member closes in a positive manner onto the seating. This is not required with the present arrangement because of the fuel flow path along the passage 51 and the drilling 56. The fuel leakage can be kept to a minimum by appropriate sizing of the clearance between the actuating piston and the cylinder. The balance plunger can be designed to dilate slightly under the high fuel pressure developed in the bore 14 so as to prevent the possibility of fuel leaking between the grooves 54 and 55 when the balance plunger is in contact with the spigot 53. The increased clearance before dilation helps the light spring 52 to operate the balance piston in a timely manner by reducing oil drag. Spring 52 is light so that it can be compressed by the output pressure of the low pressure pump 34 even at the lowest running speed of the engine i.e. start up.

Instead of the shuttle 26 and the auxiliary pistons 21 an electromagnetically operable valve may be provided to connect the ports 27 and 30 when it is required to terminate delivery of fuel.

By the arrangement described the filling period can extend for virtually the whole time between delivery periods irrespective of the injection timing and therefore in the case of a pump for supplying fuel to a six cylinder engine will be nearly twice as long i.e. nearly 40° of the distributor rotation, as compared with a ported pump. The profile of the trailing flanks of the cam lobes can be matched to the high rate of filling obtained due to the action of the spring 47 and to the lower rate of filling due to the low pressure pump so as to ensure that the cam followers always follow the cam profile. This gives a dependable shoe and roller trajectory and avoids bouncing and tipping and also impacts between the rollers and the cam ring and which can cause damage to the cam surface.

I claim:

1. A fuel pumping apparatus for supplying fuel to a compression ignition engine comprising a pumping plunger slidable within a bore, a cam for imparting inward movement to the plunger in timed relationship with the associated engine, means for distributing fuel displaced from the bore during successive inward movements of the plunger to a plurality of outlets in turn, said outlets in use being connected to the injection nozzles respectively of the associated engine, a spill valve operable to spill fuel from the bore during inward movement of the plunger, an actuating piston slidable within a cylinder, the actuating piston being biased by first resilient means towards an end wall of the cylinder, said spill valve comprising a valve member which is carried by the actuating piston and a seating which is formed in said end wall of the cylinder about a passage communicating with said bore, control valve means for admitting fluid under pressure into the cylinder to effect an initial movement of the actuating piston away from said end wall thereby lifting the valve member from the seating to allow fuel to spill from the bore into the cylinder and effect further movement of the actuating piston, a drilling formed in the actuating piston, the diameter of said drilling being slightly greater than the effective seat diameter of the valve member and seating, a balance piston slidable in said drilling, second resilient means biasing the balance piston in the direction towards said one end wall of the cylinder, a stop to limit the movement of the balance piston in the direction away from said end wall of the cylinder, and a passage in the valve member and actuating piston whereby the balance piston is subjected to the fuel pressure in the bore, said actuating piston and balance piston defining further valve means for connecting said bore to a source of fuel under pressure thereby to replenish the fuel lost through leakage and the fuel displaced through the outlet, said balance piston when the bore is full of fuel moving against the action of its spring loading relative to the actuator piston to interrupt communication between the bore and said source of fuel, the balance piston being moved into engagement with the stop during the initial inward movement of the plunger.

2. An apparatus according to claim 1, in which said first resilient means is sufficiently strong to generate a pressure in the cylinder which is greater than the pressure of said source whereby the initial outward movement of the plunger is effected by movement of the actuator piston towards said end wall.

3. An apparatus according to claim 2, including a non-return valve connected intermediate said further valve means and the source of fuel.

4. An apparatus according to claim 3, in which said further valve means is defined by a first groove in the wall of said drilling and a second groove in the periphery of said balance piston, said second groove communication with said bore and the first groove communicating with said source of fuel by way of said non-return valve.

5. An apparatus according to claim 4, in which said first groove communicates with a passage formed in the actuating piston said passage opening onto the end of the actuating piston presented to the end wall the end wall of the cylinder adjacent the end wall communicating with said source of fuel by way of said non-return valve.

6. An apparatus according to claim 4, in which said second groove communicates with said bore by way of a passage formed in the balance piston, the balance piston being designed to dilate under the action of the fuel pressure in the bore during delivery of fuel to minimise the risk of fuel leakage between said first and second grooves.

7. An apparatus according to claim 5, in which said passage in the actuating piston extends the full length thereof and at its end remote from the end wall is covered by a spring abutment, the spring abutment being engaged by one end of a spring forming said first resilient means.

8. An apparatus according to claim 1, in which said control valve means comprises a shuttle movable in unison with said plunger, said shuttle acting when at a predetermined position, to connect said cylinder with said bore thereby to effect movement of the actuating piston away from said end wall.

9. An apparatus according to claim 8, in which said predetermined position is adjustable.

10. An apparatus according to claim 9, in which said shuttle is movable by fuel displaced by an auxiliary plunger operable in synchronism with the pumping plunger.

* * * * *